US006714163B2

(12) United States Patent
Navarro et al.

(10) Patent No.: US 6,714,163 B2
(45) Date of Patent: Mar. 30, 2004

(54) STRUCTURALLY-INTEGRATED, SPACE-FED PHASED ARRAY ANTENNA SYSTEM FOR USE ON AN AIRCRAFT

(75) Inventors: Julio Angel Navarro, Kent, WA (US); Lixin Cai, Kent, WA (US); Yong U. Kim, Bellflower, CA (US)

(73) Assignee: The Boeing Company, Chicago, IL (US)

( * ) Notice: Subject to any disclaimer, the term of this patent is extended or adjusted under 35 U.S.C. 154(b) by 0 days.

(21) Appl. No.: 10/032,352

(22) Filed: Dec. 21, 2001

(65) Prior Publication Data

US 2003/0117327 A1 Jun. 26, 2003

(51) Int. Cl.[7] ..... H01Q 1/28
(52) U.S. Cl. ..... 343/705; 343/754
(58) Field of Search ..... 343/705, 700 MS, 343/754

(56) References Cited

U.S. PATENT DOCUMENTS 4,684,952 A * 8/1987 Munson et al. ..... 343/700 MS
5,184,141 A * 2/1993 Connolly et al. ..... 343/705
5,900,843 A 5/1999 Lee ..... 343/767
6,204,823 B1 3/2001 Spano et al. ..... 343/766
6,208,304 B1 3/2001 Strickland ..... 343/705

OTHER PUBLICATIONS

International Search Report dated Jun. 12, 2002 for PCT/US 02/39241, 3 pages.

* cited by examiner

*Primary Examiner*—Michael C. Wimer
(74) *Attorney, Agent, or Firm*—Harness Dickey & Pierce P.L.C.

(57) ABSTRACT

A phased array antenna system for an aircraft which allows a beam from the antenna to be scanned down to or below the horizon when the aircraft is traveling at high latitudes. The system comprises a conformal phased array antenna aperture mounted on either a top, port or a starboard side of a fuselage of the aircraft, and at least one feedhorn mounted either in a blade secured to the fuselage or in a leading edge of a horizontal stabilizer of the aircraft. The feedhorn illuminates the conformal antenna aperture and the aperture projects a beam therefrom which can be more easily directed at targets at or below the horizon. The invention allows smaller antenna apertures to be used to scan a beam toward the horizon.

21 Claims, 3 Drawing Sheets

STRUCTURALLY-INTEGRATED, SPACE-FED PHASED ARRAY ANTENNA SYSTEM FOR USE ON AN AIRCRAFT

FIELD OF THE INVENTION

The present invention relates to phased array antenna systems, and more particularly to a space-fed phased array antenna system specifically adapted for use on an exterior portion of a fuselage of an aircraft.

BACKGROUND OF THE INVENTION

With the growing interest in providing live television programming and Internet connectivity with aircraft in flight, the design and implementation of phased array antenna systems has become extremely important. The Boeing Company is a leading innovator in the design and manufacture of phased array antennas systems. U.S. Pat. No. 5,886,671 to Riemer et al and U.S. Pat. No. 5,276,455 to Fitzsimmons et al both disclose packaging architectures for phased array antennas, and are each hereby incorporated by reference into the present application.

When implementing a phased array antenna on an aircraft, such as may be employed in the Connexion By Boeing$^{SM}$ system, an important consideration is that the antenna be able to scan close to the horizon when the aircraft is at high latitudes. This heretofore required a very large antenna aperture to be disposed on a top area of the fuselage of an aircraft. However, a very large aperture of a phased array antenna is quite expensive to manufacture. Accordingly, it would be highly desirable to provide some form of antenna system which is able to make use of an antenna having a smaller aperture but which still is able to project a beam close to the horizon when the aircraft is traveling at high latitudes.

SUMMARY OF THE INVENTION

The above and other drawbacks are overcome by a structurally-integrated, space-fed phased array antenna system. The antenna system of the present invention makes use of a conformal antenna aperture which is mounted on an exterior surface of a mobile platform. In one preferred embodiment the mobile platform comprises an aircraft. In this embodiment the conformal antenna aperture is mounted on one of the port or starboard sides of the fuselage of the aircraft along the rear one-half of the fuselage. More preferably, the conformal antenna aperture is mounted on one of the port or starboard sides of the fuselage closely adjacent to one of the horizontal stabilizers of the aircraft. That horizontal stabilizer includes an antenna, such as a feedhorn, which is structurally integrated therewith. In a preferred embodiment the feedhorn is integrally formed at a leading edge of the horizontal stabilizer such that it does not produce any additional aerodynamic drag on the aircraft when the aircraft is in flight. The feedhorn provides a space feed to illuminate the conformal antenna aperture disposed on the fuselage, which in turn is able to reflect the beam at an angle that allows the beam to be directed close to the horizon when the aircraft is traveling at high latitudes.

In another preferred embodiment the conformal antenna aperture is divided into two antenna apertures: a receive antenna aperture and a transmit antenna aperture. In other preferred embodiments the feedhorn is also presented as two independent feedhorns mounted closely adjacent one another on a leading edge of a horizontal stabilizer of the aircraft.

The above described preferred embodiments all enable a conformal phased array antenna system used on an aircraft to readily project a beam below the horizon when the aircraft is flying at high latitudes. Moreover, the antenna system of the present invention does not add significantly to the aerodynamic drag experienced by the aircraft during flight.

The present invention is equally applicable to any mobile platform such as a land vehicle, ship or satellite. A principal advantage of the present invention is that the use of a space feed allows a much larger antenna aperture to be illuminated.

Further areas of applicability of the present invention will become apparent from the detailed description provided hereinafter. It should be understood that the detailed description and specific examples, while indicating the preferred embodiment of the invention, are intended for purposes of illustration only and are not intended to limit the scope of the invention.

BRIEF DESCRIPTION OF THE DRAWINGS

The present invention will become more fully understood from the detailed description and the accompanying drawings, wherein.

DETAILED DESCRIPTION OF THE PREFERRED EMBODIMENTS

The following description of the preferred embodiment(s) is merely exemplary in nature and is in no way intended to limit the invention, its application, or uses.

Figure 1:
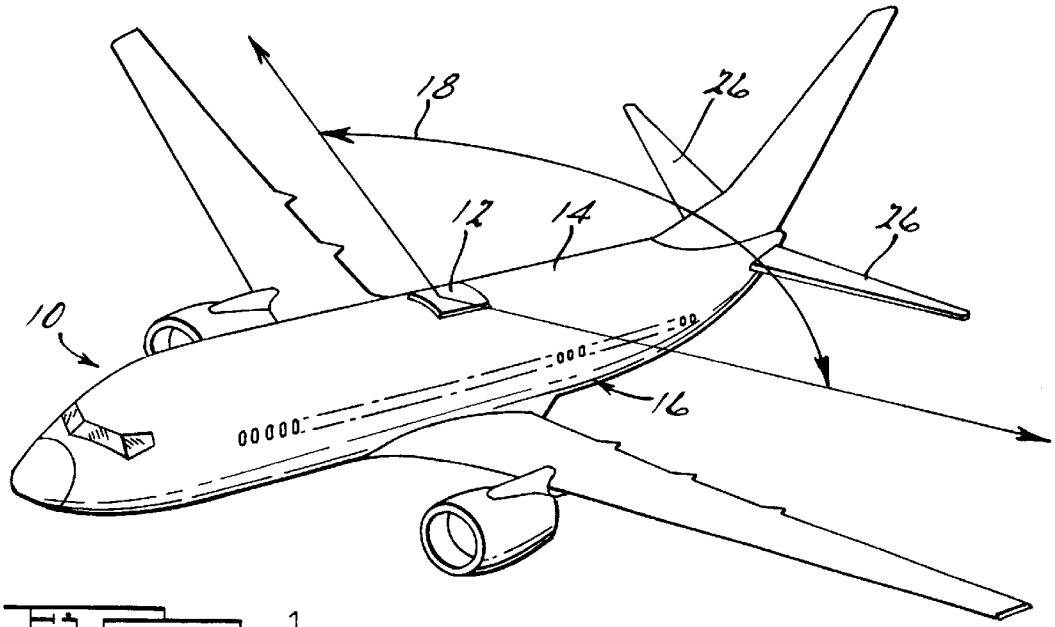
FIG. 1 is a perspective view of an aircraft illustrating a coverage pattern of a large aperture phased array antenna mounted on a top area of a fuselage of the aircraft, and further illustrating the limitations in scanning a beam from such a mounted antenna down to the horizon or below.

Referring to FIG. 1, there is shown an aircraft 10 with a large aperture phased array antenna 12 mounted on a top portion 14 of a fuselage 16 of the aircraft. Arrows 18 indicate the approximate limitations in terms of scanning a beam from the antenna 12 down to the horizon or below the horizon. As will be appreciated from the drawing of FIG. 1, it is difficult for present day phased array antenna systems to operate at scan angles which project the beam therefrom down to angles close to or parallel with the wings of an aircraft. In practice, present day phased array antennas have significantly reduced performance at scan angles of greater than about 60° from a boresight of the antenna. Accordingly, when the aircraft 10 is operating at high latitudes and is attempting to communicate with a space based device, such as a satellite based transponder orbiting over the equator, communication can be difficult or impossible with a phased array antenna mounted on a top portion of a fuselage of an aircraft. This limitation has necessitated the use of very large antenna apertures which add significantly to the cost of the antenna system.

Figure 2:
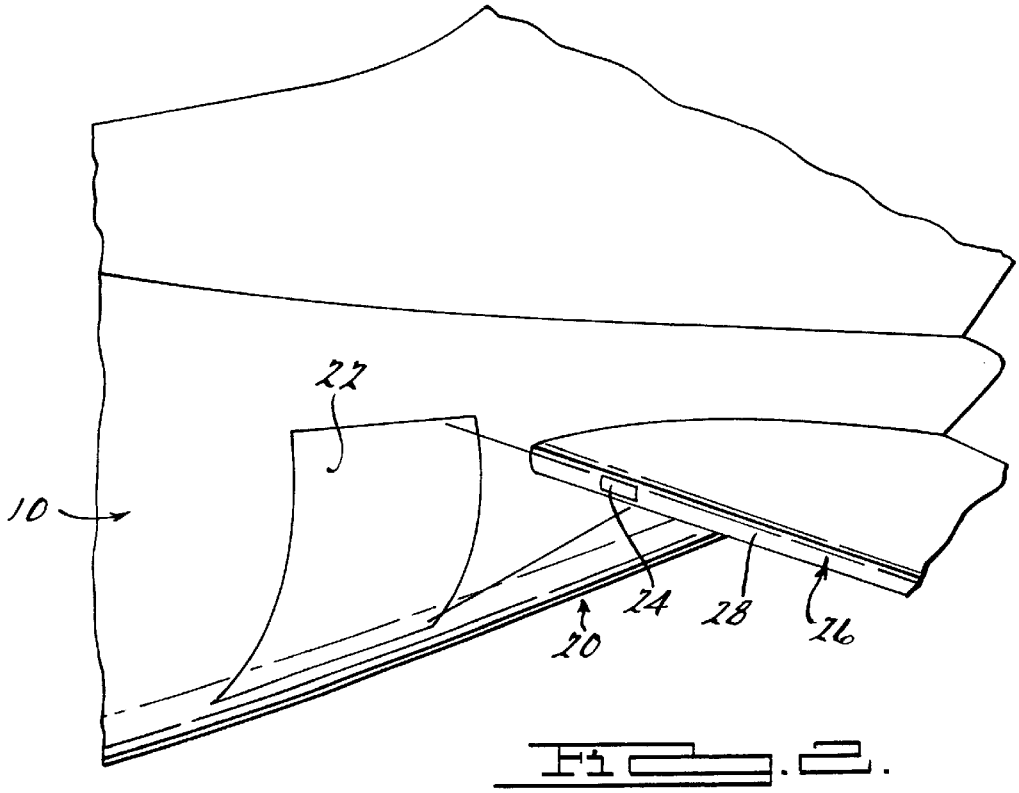
FIG. 2 is a perspective view of a portion of an aircraft illustrating a preferred embodiment of the present invention including a conformal phased array antenna mounted on a port side of the fuselage of the aircraft and a feedhorn mounted within a leading edge of a horizontal stabilizer of the aircraft.

Referring now to FIG. 2, there is shown an antenna system 20 in accordance with a preferred embodiment of the present invention. The antenna system 20 includes a conformal phased array antenna 22 and a second antenna 24, such as a feedhorn. The conformal phased array antenna 22 is mounted on either a port or a starboard side of the fuselage 16 of the aircraft 10, and further along a rear one-half portion of the fuselage 16. More preferably, the conformal antenna 22 is located on one of the port or starboard sides of the fuselage 16 closely adjacent a horizontal stabilizer 26 of the aircraft 10. The feedhorn 24 is disposed on the horizontal stabilizer 26, and more preferably on a leading edge 28 of the horizontal stabilizer 26. The conformal phased array antenna 22 is disposed within a line of sight of the feedhorn 24 such that it can be irradiated by the feedhorn 24. The antenna system 20 thus forms a space fed antenna system.

The conformal phased array antenna 22 could be formed as a completely passive conformal antenna with conventional phase-shifters used for beam steering. In this instance, the aperture of the antenna 22 must be large enough to overcome the phase shifter losses and meet the required transmission link margins with the other subsystems (such as satellite-based transponders) that the antenna 22 is in communication with. Sidelobe level suppression of the side lobes produced by the beam of the antenna 22 and/or density tapering of the beam could also be included to reduce stray radiation and thereby help to reduce the possibility of interference with other devices. Such other devices might include non-target satellite transponders orbiting in close proximity to a target satellite transponder.

Figure 4:
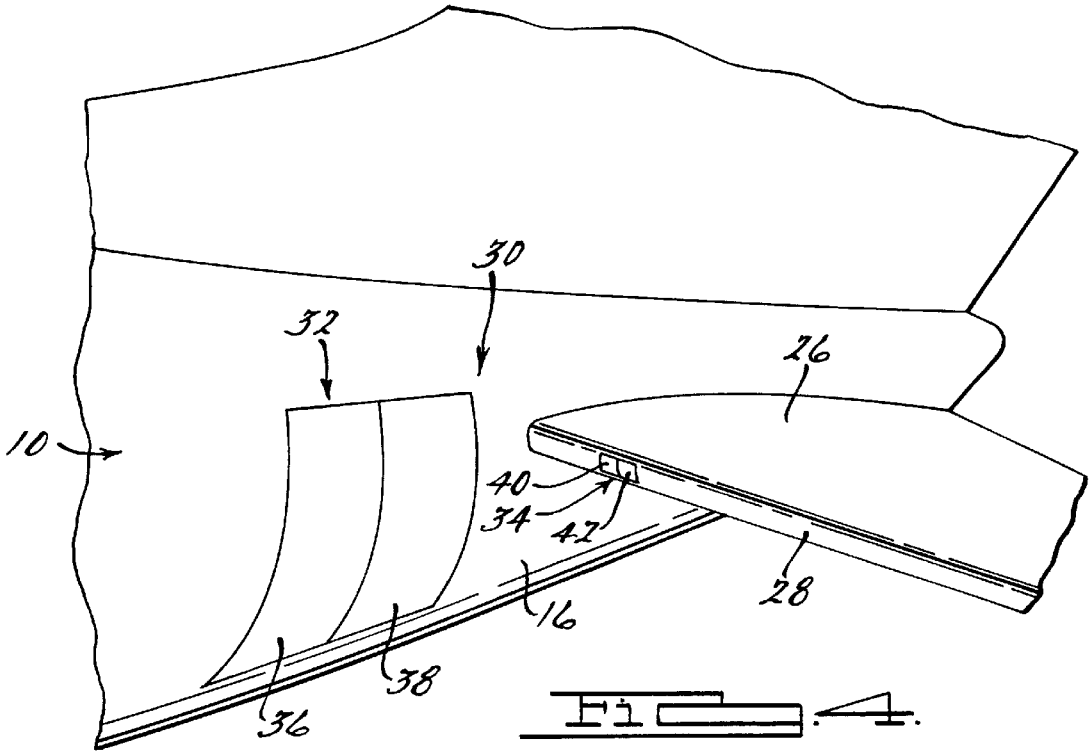
FIG. 4 is an alternative preferred embodiment of the present invention illustrating separate transmit and receive antennas being used along with separate transmit and receive feed horns.

FIG. 4 illustrates an antenna system 30 in accordance with an alternative preferred embodiment of the present invention. The antenna system 30 has a conformal phased array antenna 32 and a feedhorn assembly 34. The conformal antenna 32 includes a transmit antenna 36 and a receive antenna 38 which are disposed closely adjacent to one another on the port side of the fuselage 16 of the aircraft 10. The feedhorn assembly 34 includes a transmit feedhorn 40 and a receive feedhorn 42 disposed closely adjacent one another on the leading edge 28 of the horizontal stabilizer 26. The transmit and receive antennas 36 and 38, respectively, could form purely passive antenna apertures. The passive configuration, for each of the antenna systems 20 and 30, can be implemented provided the conformal antenna apertures have the needed bandwidth and scanning properties.

It is anticipated that each of the phased array antenna apertures 22 and 32 will be most cost effectively constructed by implementing the teachings of U.S. application Ser. No. 10/007,067, entitled "Antenna Integrated Printed Wiring Board Assembly For A Phased Array Antenna", filed Dec. 5, 2001, which discloses an apparatus and method for manufacturing an integrated, low cost phased array antenna system with a significantly reduced number of component parts, and which is hereby incorporated by reference. It is also anticipated that the use of GaAs may not be necessary in the antenna system 22 or 32. Using SiGe or other low cost alternative to GaAs, the cost of an oversized antenna aperture could be reduced to the materials needed to form printed wiring board material, phase shifters and ASICs to control the beam steering.

In the preferred embodiments described above, it is further preferred that critical electronic components associated with such phased array antenna systems are housed with the horn 24 or 34 within the horizontal stabilizer 26. For a passive phased array antenna aperture, a single horn can be employed with a circulator. Alternatively, two separate horns can be employed as described herein. In either case, suitable transmit and receive filters are included with up and down converters.

It will also be appreciated that with the transmit phased array antenna 36 shown in FIG. 4, a smaller transmit aperture could be employed which uses suitable power amplifiers therewith. Similarly, on the receive antenna aperture 38, a smaller aperture could be employed if low noise amplifiers are included for use therewith. In this instance, the electrical and mechanical complexity increases along with some additional costs.

The use of a proven phased array antenna manufactured by the assignee of the present invention, utilizing loaded circular wave guides with wide-angle impedance matching (WAIM) sheets, provides excellent performance over a large field of view. Such phased array antennas and their constructions are disclosed in U.S. Pat. No. 5,886,671 to Riemer et al and U.S. Pat. No. 5,276,455 to Fitzimmons et al, both of which are hereby incorporated by reference. Pending U.S. patent application Ser. No. 09/915,836, entitled "Antenna-integrated Ceramic Chip Carrier For Phased Array Antennas", assigned to the assignee of the present application and is also hereby incorporated by reference, also discloses manufacturing techniques for significantly reducing the cost of phased array antennas.

It will also be appreciated that the antenna apertures 22 and 32 can be made doubly conformal, if desired, to the inside or outside of a structure. This makes the antenna apertures 22 and 32 ideally suited for an aircraft. Since the phased array antenna apertures 22 and 32 have an extremely low profile, they do not protrude significantly above the skin of the fuselage 16 and therefore do not produce any significant additional aerodynamic drag on the aircraft 10 when the aircraft is in flight. Also, it will be appreciated that the antenna apertures 22 and 32 could also be integrated into the fuselage 16 during construction of the aircraft 10 such that the antenna apertures 22 and 32 are essentially flush with the skin of the fuselage.

Figure 3:
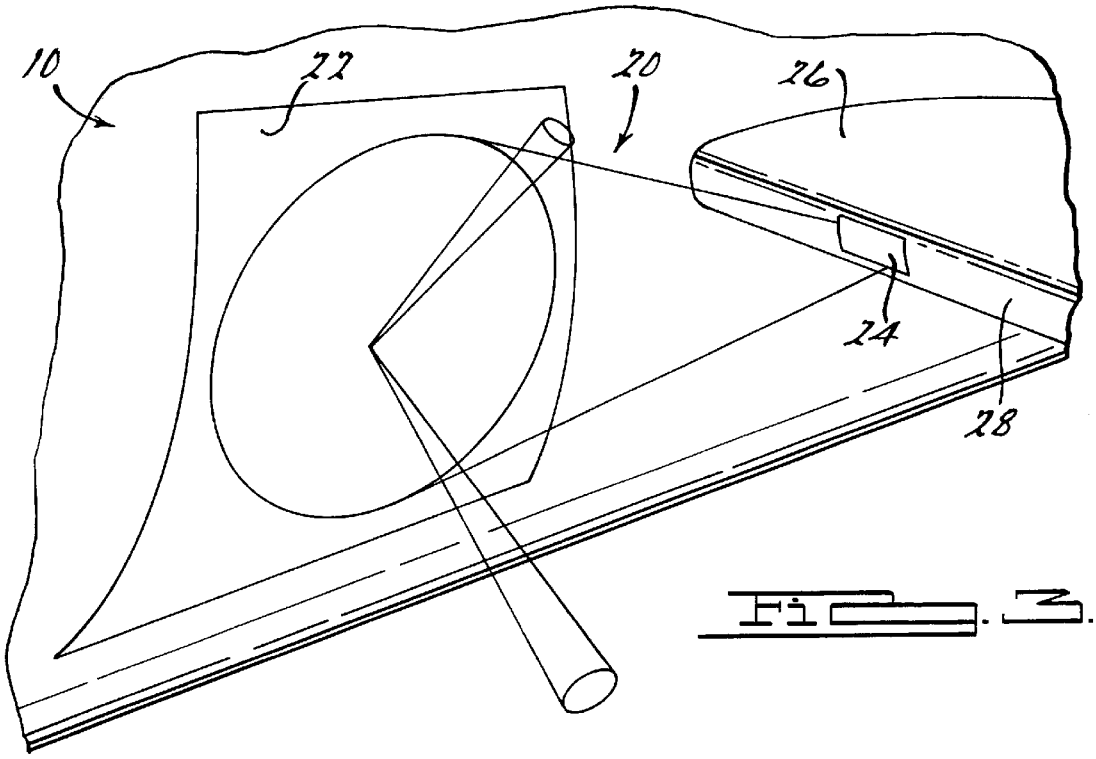
FIG. 3 is a perspective view of the antenna system of FIG. 2 illustrating the feedhorn illuminating the conformal antenna aperture.

Concerning the feedhorns 24 (FIG. 3) and 34 (FIG. 4), it will be appreciated that in the embodiments illustrated, these components are also integrally formed into the leading edge 28 of the horizontal stabilizer 26 such that they do not cause any significant additional aerodynamic drag on the aircraft 10. The electronics associated with the feedhorns 24 and 34 are also preferably disposed within the horizontal stabilizer 26.

Figure 5:
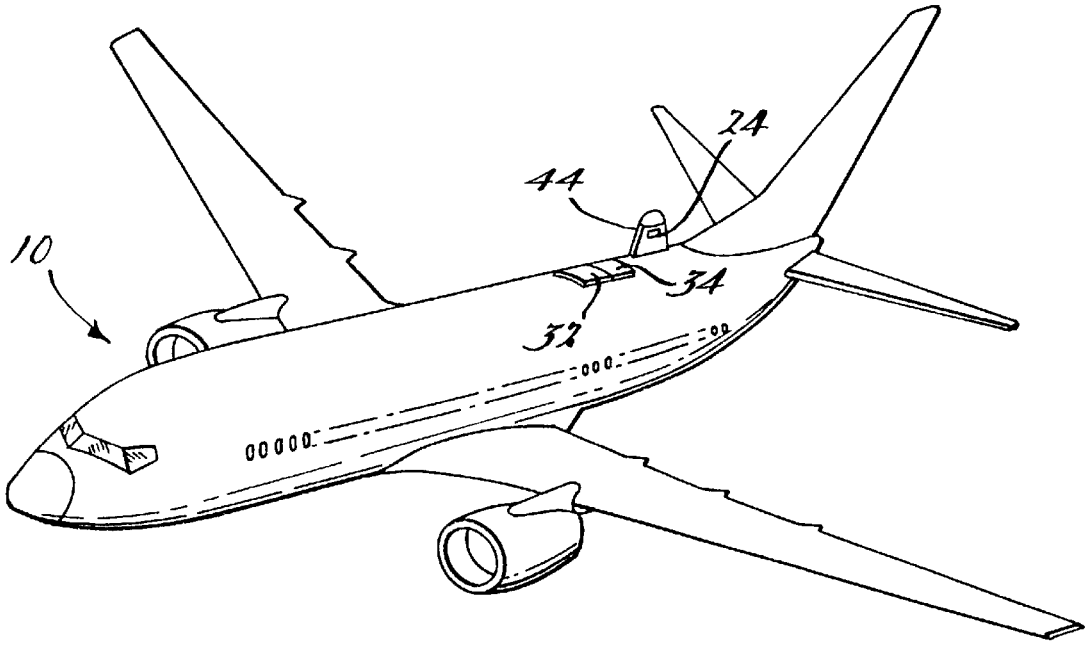
FIG. 5 is a perspective view of an alternative preferred embodiment of the present invention wherein the feed horn is incorporated into a blade mounted on an exterior surface of the aircraft.

It will also be appreciated, however, that the feed horn 24 could be incorporated into a blade 44 mounted at any point on the aircraft 10, as indicated in FIG. 5. FIG. 5 also shows transmit and receive antenna apertures 32 and 34 mounted atop the aircraft 10. Thus, it will be appreciated that the space feed arrangement disclosed herein allows the use of larger antenna apertures at a variety of locations on the aircraft 10, and not just on the sides of the fuselage 16. The space feed approach allows larger antenna apertures to be used on virtually any type of moving platform such as a land vehicle, a ship or even satellite.

The preferred embodiments of the present invention are thus particularly effective in providing an antenna system which allows a beam from a conformal phased array antenna mounted on an aircraft to be directed down close to or below the horizon when the aircraft is traveling at high latitudes. Advantageously, the preferred embodiments do not form significant protrusions on the fuselage of the aircraft, and thereby do not negatively impact the aerodynamic performance of the aircraft when the aircraft is in flight.

Those skilled in the art can now appreciate from the foregoing description that the broad teachings of the present invention can be implemented in a variety of forms. Therefore, while this invention has been described in connection with particular examples thereof, the true scope of the invention should not be so limited since other modifications will become apparent to the skilled practitioner upon a study of the drawings, specification and following claims.

What is claimed is:

1. An antenna system for a mobile platform for enabling wireless communication with a space-based device, said antenna system comprising:

a first antenna disposed one of flush with and above a skin of said mobile platform at a first area of said mobile platform;

a second antenna mounted on said mobile platform at a second area of said mobile platform spaced apart from said first area and within a line of sight of said first antenna, and further wherein said first and second antennas are structurally independent components supported independently of one another, for providing a signal feed to said first antenna; and said first antenna enabling a beam generated thereby to be steered toward said space-based device, said space based device being spaced apart from and in wireless communication with said mobile platform.

2. The antenna system of claim 1, wherein said first antenna comprises a conformal phased array antenna.

3. The antenna system of claim 2, wherein said second antenna comprises a feed horn.

4. An antenna system for an aircraft for enabling wireless communication with a space-based device, said antenna system comprising:

a first antenna disposed one of flush with and above a skin of a fuselage of said aircraft at a first area of said aircraft;

a second antenna supported on said aircraft at a second area of said aircraft spaced apart from said first area and within a fine of sight of said first antenna, and further wherein said first and second antennas are structurally independent components supported independently of one another, for providing a signal feed to said first antenna, said second antenna being positioned to minimize an aerodynamic drag on said aircraft; and said first antenna enabling a beam generated thereby to be steered toward, a horizon of the earth.

5. The antenna system of claim 4, wherein said first antenna comprises a conformal phased array antenna.

6. The antenna system of claim 4, wherein said second antenna comprises a feed horn.

7. The antenna system of claim 4, wherein said first antenna comprises separate transmit and receive antennas disposed adjacent to one another on said fuselage.

8. The antenna system of claim 4, wherein said second antenna comprises a plurality of teed horns disposed on a horizontal stabilizer of said aircraft.

9. The antenna system of claim 4, wherein said second antenna comprises a feed horn disposed within a blade mounted on said fuselage of said aircraft.

10. The antenna system of claim 4, wherein said first antenna is mounted on one of a starboard side and port side of said fuselage.

11. An antenna system for an aircraft for enabling wireless communication with a space-based device during flight of the aircraft, said antenna system comprising:

a conformal antenna disposed one of flush with and above a skin of a fuselage of said aircraft at a position along one of a port and starboard side of said fuselage, and along a rear half of said fuselage within a line of sight of a horizontal stabilizer of said aircraft;

a feed horn integrally formed into a leading edge of a horizontal stabilizer of said aircraft within a line of sight of said conformal antenna for providing a space fed signal to said conformal antenna; and said conformal antenna enabling a beam from said antenna to be steered within a range including both above and below a horizon of the earth while said aircraft is in flight.

12. The antenna system of claim 11, wherein said conformal antenna comprises a conformal, phased array antenna.

13. A method for transmitting wireless information from an aircraft, comprising:

disposing a first antenna one of flush with and above a skin of a fuselage of said aircraft;

disposing a second antenna on a portion of said aircraft projecting from said fuselage such that said second antenna is disposed within a line of sight of said first antenna;

using said second antenna to provide a space fed signal to said first antenna; and using said first antenna to receive said space fed signal and to project a beam toward a separate airborne device.

14. The method of claim 13, wherein the step of disposing said first antenna comprises disposing a conformal, phased array antenna on said portion of said fuselage.

15. The method of claim 13, wherein the step of disposing said second antenna comprises disposing a feed horn on said portion of said fuselage.

16. The method of claim 13, wherein the step of disposing said second antenna comprises disposing a pair of feed horns on said portion of said fuselage.

17. The method of claim 13, wherein the step of disposing said first antenna on said fuselage comprises the step of disposing both of a conformal transmit phased array antenna and a conformal receive phased on said fuselage.

18. A method for transmitting wireless information from an aircraft, comprising:

disposing a first antenna one of flush with and above a skin of a fuselage of said aircraft on one of a starboard side and a port side of said aircraft, and along a rear one half of said aircraft within a line of sight of a horizontal stabilizer of said aircraft;

disposing a second antenna on said horizontal stabilizer of said aircraft within a line of sight of said first antenna;

using said second antenna to provide a space fed signal to said first antenna; and using said first antenna to receive said space fed signal and to project a beam toward a separate airborne device.

19. The method of claim 18 wherein the step of disposing a first antenna on a fuselage comprises disposing a conformal phased array antenna on said fuselage.

20. The method of claim 18, wherein the step of disposing a second antenna on a horizontal stabilizer comprises a disposing a feed horn on said horizontal stabilizer.

21. The method of claim 18, wherein the step of disposing a first antenna on a fuselage comprises the step of disposing a conformal transmit antenna phased array antenna and a conformal receive phased array antenna on said fuselage.

* * * * *